US009973068B2

(12) United States Patent
Allmendinger et al.

(10) Patent No.: US 9,973,068 B2
(45) Date of Patent: May 15, 2018

(54) CAST COPPER ALLOY FOR ASYNCHRONOUS MACHINES

(71) Applicant: Wieland-Werke AG, Ulm (DE)

(72) Inventors: Timo Allmendinger, Blaustein (DE); Tony Robert Noll, Dieternheim (DE); Joachim Riedle, Bad Wurzach (DE); Gerhard Thumm, Erbach (DE)

(73) Assignee: WIELAND-WERKE AG, Ulm (DE)

( * ) Notice: Subject to any disclaimer, the term of this patent is extended or adjusted under 35 U.S.C. 154(b) by 350 days.

(21) Appl. No.: 14/779,161

(22) PCT Filed: Apr. 10, 2014

(86) PCT No.: PCT/EP2014/000957
§ 371 (c)(1),
(2) Date: Sep. 22, 2015

(87) PCT Pub. No.: WO2014/173498
PCT Pub. Date: Oct. 30, 2014

(65) Prior Publication Data

US 2016/0056698 A1 Feb. 25, 2016

(30) Foreign Application Priority Data

Apr. 26, 2013 (DE) ..... 10 2013 007 274

(51) Int. Cl.

| | |
|---|---|
| ***C22C 9/00*** | (2006.01) |
| ***C22C 9/01*** | (2006.01) |
| ***C22C 9/02*** | (2006.01) |
| ***C22C 9/04*** | (2006.01) |
| ***H02K 17/16*** | (2006.01) |
| ***C22C 9/06*** | (2006.01) |
| ***C22C 21/00*** | (2006.01) |

(52) U.S. Cl.
CPC ..... *H02K 17/165* (2013.01); *C22C 9/00* (2013.01); *C22C 9/02* (2013.01); *C22C 9/04* (2013.01); *C22C 9/06* (2013.01); *C22C 21/00* (2013.01)

(58) Field of Classification Search
None
See application file for complete search history.

(56) References Cited

U.S. PATENT DOCUMENTS

| | | | |
|---|---|---|---|
| 2,304,067 | A | 12/1942 | Anderson |
| 4,732,731 | A | 3/1988 | Asai et al. |
| 5,315,152 | A | 5/1994 | Kuse et al. |
| 6,110,577 | A | 8/2000 | Ishikawa et al. |
| 6,479,095 | B1 | 11/2002 | Ishikawa et al. |
| 7,337,526 | B2 | 3/2008 | Sweo |

FOREIGN PATENT DOCUMENTS

| | | | |
|---|---|---|---|
| CN | 102394118 | A | 3/2012 |
| CN | 103069025 | A | 4/2013 |
| DE | 503 187 | | 7/1930 |
| DE | 33 24 687 | A1 | 12/1984 |
| DE | 43 29 679 | C2 | 3/1994 |
| DE | 100 14 643 | C2 | 10/2001 |
| DE | 691 33 422 | T2 | 2/2006 |
| DE | 20 2004 020 873 | U1 | 5/2006 |
| DE | 698 35 914 | T2 | 5/2007 |
| DE | 10 2009 018 951 | A1 | 11/2010 |
| EP | 0 652 624 | A1 | 5/1995 |
| EP | 1 612 285 | A1 | 1/2006 |
| EP | 1 801 249 | A1 | 6/2007 |
| EP | 2 241 643 | A1 | 10/2010 |
| EP | 2 610 358 | A1 | 7/2013 |
| GB | 949570 | | 2/1964 |
| JP | 52120222 | A | 10/1977 |
| JP | 56010059 | A | 2/1981 |
| JP | 58006950 | A | 1/1983 |
| JP | 61-147830 | A | 7/1986 |
| JP | H 04052240 | A | 2/1992 |
| JP | 2011-27280 | A | 2/2011 |
| JP | 5158915 | B2 | 3/2013 |

OTHER PUBLICATIONS

Office Action of Japan Patent Office issued in Application No. 2016-509319 with English translation dated Jan. 17, 2017 (18 pages).
English translation of Office Action of People's Republic of China Patent Office issued in Application No. 201480009267.1 dated Jul. 29, 2016 (8 pages).
International Search Report issued in International Application No. PCT/EP2014/000957 with English translation, dated Jul. 29, 2014 (4 pages).
Office Action of German Patent Office issued in Application No. 10 2013 007 274.3 dated Nov. 28, 2013 (5 pages).

*Primary Examiner* — Deborah Yee
(74) *Attorney, Agent, or Firm* — Flynn, Thiel, Boutell & Tanis, P.C.

(57) ABSTRACT

A copper alloy having the following composition (in % by weight): in each case 0.05 to 0.5% of at least three elements selected from the group consisting of Ag, Ni, Zn, Sn and Al, remainder Cu and unavoidable impurities, optionally 0.01 to 0.2% of one or more elements selected from the group consisting of Mg, Ti, Zr, B, P, As, Sb. Also, a current-carrying structural part made of a copper alloy and a cage rotor having multiple conductor bars and two short-circuiting rings, which are cast in one piece from a copper alloy.

10 Claims, No Drawings

CAST COPPER ALLOY FOR ASYNCHRONOUS MACHINES

The invention relates to copper casting alloys and to current-conducting construction components produced therefrom by primary forming. More particularly, the invention relates to cast cage rotors for asynchronous machines.

It is already known from patent DE 503 187 that cage rotors for asynchronous machines can be produced by simultaneous casting of the rotor bars and the short-circuiting rings. The rotor bars and short-circuiting rings have thus been executed as a one-piece component, the material of which is in the cast state. Possible casting methods specified are, for example, die casting in DE 43 29 679 C2, lost foam casting in U.S. Pat. No. 7,337,526 B2, and centrifugal casting in U.S. Pat. No. 2,304,067. Copper and copper alloys, because of their high electrical conductivity, are important materials for the production of cast cage rotors. Since the material is in the cast state, it is readily formable. Therefore, the increase in strength of the copper material by alloying elements is of great significance. On the other hand, it is desirable for the electrical conductivity to be reduced only slightly by the alloying elements. Furthermore, the material has to have good castability. Alloying constituents used are often zirconium and/or chromium. JP 56010059A proposes, for the die casting method, a copper alloy comprising zinc, chromium, zirconium and titanium.

Further copper alloys for cage rotors are known in connection with production methods in which the cage rotor is not cast in one piece but is assembled from individual components. In this case, the conductor bars and/or the short-circuiting rings are produced by means of primary forming methods. For example, GB 949,570 proposes, for current-conducting components, a cold-formed and heat-treated copper alloy containing between 0.1% and 0.25% zirconium. JP 58006950A proposes a copper alloy containing iron, zinc and optionally tin and phosphorus. The cage rotor produced from this alloy is manufactured from a hot-rolled ribbon. For the short-circuiting rings, DE 100 14 643 C2 proposes the alloys CuCrZr and CuNi, the strength of which can be increased as a result of precipitation hardening through the addition of further elements, for example silicon. DE 10 2009 018 951 A1 proposes cage rotors in which the short-circuiting rings consist of a copper-silver alloy. DE 33 24 687 A1 proposes manufacturing the conductor bars from a copper-silver alloy. The same document also proposes, as an alternative, a copper-zinc alloy. EP 0 652 624 A1 describes a multipart construction of the conductor bars. For the wedge-like part which is the outer part in radial direction, various copper alloys are proposed, the conductivity of which is characterized as at least 20% IACS. The person skilled in the art is unable to find any pointer as to the castability of the alloys in the document.

Copper materials processed by primary forming methods feature a higher strength than copper materials in the cast state. The person skilled in the art is thus unable to infer any pointer from the abovementioned prior art as to which copper alloy in the cast state as well has a favorable combination of properties in terms of electrical conductivity and strength.

It is therefore an object of the invention to specify cast copper alloys that are improved in terms of strength, conductivity and castability, and current-conducting construction components that are improved in terms of strength and conductivity. More particularly, the invention is to specify improved cage rotors cast in one piece for asynchronous machines. At the same time, the selection of the alloying elements should also be made with regard to the effects on health and the environment. More particularly, lead and cadmium should be avoided.

The invention with regard to a copper alloy is described below along, with regard to a construction component, and with regard to a cage rotor, along with further advantageous forms and developments of the invention.

The invention includes copper alloys having the following composition in % by weight:

0.05% to 0.5% of each of at least three elements from the group consisting of Ag, Ni, Zn, Sn and Al, the balance being Cu and unavoidable impurities, optionally 0.01% to 0.2% of one or more elements from the group consisting of Mg, Ti, Zr, B, P, As, Sb.

The invention proceeds from the consideration that the strength of metals is increased by the incorporation of foreign atoms. This effect is of particular interest for cast alloys because high strength values can already be achieved in this way without further primary forming steps. A particularly great effect on the strengthening of the solid solution in the case of copper is possessed by the elements Al, Sn, Ni and Zn. If the strength of pure copper is to be increased by strengthening of the solid solution, the addition of Al and Sn is particularly worthwhile. It is also known that the addition of alloying elements fundamentally worsens the electrical and thermal conductivity of pure copper. In the area of solid solution formation, however, the conductivity of copper is affected to a relatively small degree by the elements Zn, Ag, Ni, Sn and Al. If the electrical conductivity of copper is to be impaired to a minimum degree, the addition of Zn and Ag is particularly worthwhile. Through a suitable selection of at least three elements from the group consisting of the elements Ag, Ni, Zn, Sn and Al, it is possible to find a cast material having a particularly favorable combination of strength and conductivity. The content of the individual elements here should be at least 0.05% by weight and at most 0.5% by weight. At element contents less than 0.05% by weight, the effect of the alloying elements is too small. Preferably, even in the case of fewer than five alloying elements, the sum total of the element contents may be at least 0.25% by weight. In the case of element contents greater than 0.5% by weight, there may be unwanted separation of the alloy or segregation. In order to reliably avoid such effects, the content of the individual elements may preferably be not more than 0.3% by weight. The addition of three or more elements to the alloy gives rise to an alloy having a melting range greater than the melting range of alloys comprising fewer elements. This has a favorable effect on the castability of the material. Preferably, the copper alloy contains at least one of the elements Ag and Sn. This results in particularly favorable properties. More preferably, the copper alloy contains the element Ag. This results in particularly favorable properties in terms of electrical conductivity. It is optionally possible to add to the alloy 0.01% to 0.2% by weight of one or more elements from the group consisting of Mg, Ti, Zr, B, P, As, Sb. These elements bring about grain refinement of the cast structure and thus increase the strength of the cast material. By deoxidation of the melt, they can also reduce gas absorption. In order to avoid unwanted interactions between the elements, the sum total of the contents of the elements Mg, Ti, Zr, B, P, As, Sb may be limited to a maximum of 0.5% by weight. Alternatively, the content of the individual elements may be limited to a maximum of 0.07% by weight.

Preferably, the copper alloy may have the following composition in % by weight:

0.05% to 0.5% of each of three elements from the group consisting of Ag, Ni, Zn, Sn and Al, the balance being Cu and unavoidable impurities, optionally 0.01% to 0.2% of one or more elements from the group consisting of Mg, Ti, Zr, B, P, As, Sb.

The addition of exactly three alloying elements from the group consisting of the elements Ag, Ni, Zn, Sn and Al enables sufficient variation in the parameters to find a casting material having a particularly favorable combination of strength and conductivity. In the case of exactly three alloying elements, the alloy can be produced in an easily controllable manner. Preferably, the copper alloy contains the element Ag. This results in particularly favorable properties in terms of electrical conductivity. The other two alloying elements in that case should be selected from the group consisting of the elements Ni, Zn, Sn and Al. The following combinations of alloying elements have been found to be particularly attractive:

a) copper alloy having 0.05%-0.5% by weight each of Ag, Ni, Zn;
b) copper alloy having 0.05%-0.5% by weight each of Ag, Sn, Ni;
c) copper alloy having 0.05%-0.5% by weight each of Ag, Zn, Al.

Preferably, the Ag content here is not more than 0.15% by weight.

Surprisingly, the following combination of elements also results in an alloy having favorable properties:

d) copper alloy having 0.05%-0.5% by weight each of Sn, Zn, Al.

The alloys referred to above as a), b), c) and d) may optionally be supplemented by 0.01% to 0.2% by weight of one or more elements from the group consisting of Mg, Ti, Zr, B, P, As, Sb.

Preferably, the copper alloy may have the following composition in % by weight:

0.06% to 0.3% of each of three elements from the group consisting of Ag, Ni, Zn, Sn and Al, the balance being Cu and unavoidable impurities, optionally 0.01% to 0.2% of one or more elements from the group consisting of Mg, Ti, Zr, B, P, As, Sb.

With regard to the elements from the group consisting of Ag, Ni, Zn, Sn and Al, the increase in strength is not always sufficient in the case of contents less than 0.06% by weight. In the case of element contents greater than 0.3% by weight, the electrical conductivity may be reduced too significantly, for example below 70% IACS. Preferably, the sum total of the proportions of the elements from the group consisting of Ag, Ni, Zn, Sn and Al is at least 0.20% by weight and not more than 0.75% by weight. This results in alloys having particularly favorable combinations of properties in terms of strength and electrical conductivity in the cast state. More preferably, the Ag content, for reasons of cost, is not more than 0.15% by weight.

More preferably, the copper alloy may have the following composition in % by weight:

0.06% to 0.15% of each of three elements from the group consisting of Ag, Ni, Zn, Sn and Al, the balance being Cu and unavoidable impurities, optionally 0.01% to 0.2% of one or more elements from the group consisting of Mg, Ti, Zr, B, P, As, Sb.

With regard to the elements from the group consisting of Ag, Ni, Zn, Sn and Al, the increase in strength is not always sufficient in the case of contents less than 0.06% by weight. In the case of element contents greater than 0.15% by weight, the electrical conductivity may be reduced too significantly, for example below 75% IACS. Preferably, the sum total of the proportions of the elements from the group consisting of Ag, Ni, Zn, Sn and Al is at least 0.20% by weight and not more than 0.35% by weight.

Preferably, in the case of the copper alloy of the invention, the proportions of the alloying elements may be selected such that the ratio of the proportions by weight of any two alloying elements from the group consisting of Ag, Ni, Zn, Sn and Al is not more than 1.5. The more common of the two alloying elements here forms the numerator in the quotient to be calculated. More preferably, this weight ratio is not more than 1.3. It has been found to be favorable with regard to strength and conductivity in the cast state when the elements selected from the group consisting of Ag, Ni, Zn, Sn and Al for the respective alloy are added to the alloy in approximately equal proportions by weight.

In a preferred configuration of the invention, the copper alloy may have the following composition in % by weight:

Ag: 0.06% to 0.5%

Ni: 0.06% to 0.5%

Zn: 0.06% to 0.5% the balance being Cu and unavoidable impurities, optionally 0.01% to 0.2% of one or more elements from the group consisting of Mg, Ti, Zr, B, P, As, Sb. An alloy of this kind has an electrical conductivity of at least 68% IACS and can surpass the strength of pure copper by up to 35%.

In a particularly preferred configuration of the invention, the copper alloy may have the following composition in % by weight:

Ag: 0.06% to 0.15%

Ni: 0.06% to 0.15%

Zn: 0.06% to 0.15% the balance being Cu and unavoidable impurities, optionally 0.01% to 0.2% of one or more elements from the group consisting of Mg, Ti, Zr, B, P, As, Sb. An alloy of this kind, at about 90% IACS, has an electrical conductivity about equal to that of a copper alloy containing 1% by weight of Ag (CuAg1). The increase in strength compared to pure copper in the cast state is about 20%. Thus, an alloy of this kind has a very favorable combination of properties. The relative increase in strength is greater than the relative decrease in conductivity. Because of the small alloy fractions, the alloy is at the cost level of commercial copper alloys.

In a further advantageous configuration of the invention, the copper alloy may have the following composition in % by weight:

Ag: 0.06% to 0.15%

Sn: 0.06% to 0.15%

Ni: 0.06% to 0.15% the balance being Cu and unavoidable impurities, optionally 0.01% to 0.2% of one or more elements from the group consisting of Mg, Ti, Zr, B, P, As, Sb. An alloy of this kind has an electrical conductivity of about 85% IACS. The increase in strength compared to pure copper in the cast state is about 20%. Thus, an alloy of this kind has a very favorable combination of properties. The relative increase in strength is greater than the relative decrease in conductivity. Because of the small alloy fractions, the alloy is at the cost level of commercial copper alloys.

In a further advantageous configuration of the invention, the copper alloy may have the following composition in % by weight:

Ag: 0.06% to 0.15%

Zn: 0.06% to 0.15%

Al: 0.06% to 0.15% the balance being Cu and unavoidable impurities, optionally 0.01% to 0.2% of one or more elements from the group consisting of Mg, Ti, Zr, B, P, As, Sb. An alloy of this kind has an electrical conductivity of about 85% IACS. The increase in strength compared to pure copper in the cast state is about 10%. Because of the elements Zn and Al, this alloy is an inexpensive alternative.

In a further advantageous configuration of the invention, the copper alloy may have the following composition in % by weight:

Sn: 0.06% to 0.15%

Zn: 0.06% to 0.15%

Al: 0.06% to 0.15% the balance being Cu and unavoidable impurities, optionally 0.01% to 0.2% of one or more elements from the group consisting of Mg, Ti, Zr, B, E, As, Sb. An alloy of this kind has an electrical conductivity of about 80% IACS. The increase in strength compared to pure copper in the cast state is about 10%. Since this alloy does not contain any silver, it is a particularly inexpensive alternative.

A further aspect of the invention relates to current-conducting construction components made from copper alloys, wherein the construction components have been produced by means of a primary forming method and wherein the copper alloys have the following composition in % by weight: 0.05% to 0.5% of each of at least three elements from the group consisting of Ag, Ni, Zn, Sn and Al, the balance being Cu and unavoidable impurities, optionally 0.01% to 0.2% of one or more elements from the group consisting of Mg, Ti, Zr, B, P, As, Sb. Construction components of this kind may, for example, be switches, commutators, abrasive bodies, conductor rails, contacts, brushes, bridges, components for switchgear, conductor bars or short-circuiting rings for cage rotors or other components. Primary forming methods are understood to mean casting methods, for example die casting, fine casting, lost foam casting or other methods. In contrast to permanent mold casting, with which predominantly starting material for semiconductor manufacture is cast, the cast body in the aforementioned casting methods essentially already has the shape of the desired construction component. By means of dividing methods, it is possible to conduct one or more further processing steps which slightly alter the shape of the construction component. Examples thereof are the removal of the sprue or the reprocessing of the surface of the construction component. However, there are no subsequent processing steps by primary forming which convert the material of the construction component to another state. Consequently, the finished construction component is in the cast state. The copper alloys of the invention, because of the strengthening of the solid solution in the cast state, have higher strength than pure copper. The electrical conductivity is reduced to a comparatively small degree compared to pure copper. The alloys of the invention also have good castability: they exhibit only a minor tendency to absorb gas and are characterized by a good mold-filling capacity. Through a suitable selection of the alloying elements and the alloy composition, it is possible to find an alloy appropriate for the particular use. More particularly, the content of Ag can be restricted to 0.15% by weight. The metal costs of the alloys of the invention are increased by a maximum of 15% compared to pure copper. The complexity of production of construction components produced by primary forming methods is lower than for construction components manufactured from semi-finished products. The overall costs of the construction components of the invention can consequently be lower than the overall costs for other construction components. Optionally, the alloy of the invention may contain 0.01% to 0.2% by weight of one or more elements from the group consisting of Mg, Ti, Zr, B, P, As, Sb. These elements bring about grain refinement of the cast structure and thus increase the strength of the cast material. Through deoxidation of the melt, they can also reduce the gas absorption.

A further aspect of the invention relates to cage rotors having a plurality of conductor bars and two short-circuiting rings cast in one piece from a copper alloy. According to the invention, the copper alloy has the following composition in % by weight: 0.05% to 0.5% of each of at least three elements from the group consisting of Ag, Ni, Zn, Sn and Al, the balance being Cu and unavoidable impurities, optionally 0.01% to 0.2% of one or more elements from the group consisting of Mg, Ti, Zr, B, P, As, Sb.

The invention proceeds from the consideration of casting conductor bars and short-circuiting rings of cage rotors in one piece. Suitable casting methods for this purpose may be die casting, fine casting, lost foam casting and other methods. Because of their high electrical conductivity, copper alloys are of good suitability for the production of cage rotors. Since, because of the high speeds of the asynchronous machines, large forces act particularly on the conductor bars of the cage rotors, the copper alloys used have to have a high strength even in the cast state. Particularly suitable copper alloys are therefore those having the following composition in % by weight: 0.05% to 0.5% of each of at least three elements from the group consisting of Ag, Ni, Zn, Sn and Al, the balance being Cu and unavoidable impurities. The copper alloys of the invention, because of the strengthening of the solid solution in the cast state, have higher strength than pure copper. The electrical conductivity is reduced to a comparatively small degree compared to pure copper. The alloys of the invention also have good castability: they exhibit only a minor tendency to absorb gas and are characterized by a good mold-filling capacity. Optionally, the alloy of the invention may contain 0.01% to 0.2% of one or more elements from the group consisting of Mg, Ti, Zr, B, P, As, Sb. These elements bring about grain refinement of the cast structure and thus increase the strength of the cast material. Through a suitable selection of the alloying elements and the alloy composition, it is possible to find an alloy appropriate for the particular use. More particularly, the following alloys are found to be advantageous:

copper alloys having the following composition in % by weight:

Ag: 0.06% to 0.15%

Ni: 0.06% to 0.15%

Zn: 0.06% to 0.15% balance: Cu and unavoidable impurities;

alternative: copper alloys having the following composition in % by weight:

Ag: 0.06% to 0.15%

Sn: 0.06% to 0.15%

Ni: 0.06% to 0.15% balance: Cu and unavoidable impurities;
alternative: copper alloys having the following composition in % by weight:
Ag: 0.06% to 0.15%
Zn: 0.06% to 0.15%
Al: 0.06% to 0.15%
balance: Cu and unavoidable impurities;
alternative: copper alloys having the following composition in % by weight:
Sn: 0.06% to 0.15%
Zn: 0.06% to 0.15%
Al: 0.06% to 0.15%
balance: Cu and unavoidable impurities.

Each of the aforementioned alloys may optionally be supplemented by 0.01% to 0.2% by weight of one or more elements from the group consisting of Mg, Ti, Zr, B, P, As, Sb. The metal costs of the alloys of the invention are increased by a maximum of 15% compared to pure copper.

The invention is elucidated in detail by the working examples which follow.

Table 1 shows a summary of the alloys examined. For each alloy, the composition of the sample, the tensile strength $R_m$ determined in the cast state and the relative electrical conductivity, expressed by the IACS value, are reported. The metal costs calculated from the alloy composition are normalized to the metal costs for pure copper (sample no. 1).

TABLE 1

Characterization of the samples examined

| No. | Alloy | Cu % by wt. | Ag % by wt. | Sn % by wt. | Ni % by wt. | Zn % by wt. | Al % by wt. | Tensile strength $R_m$ MPa | IACS | Metal costs normalized |
|---|---|---|---|---|---|---|---|---|---|---|
| 1 | Cu | 100 | 0 | 0 | 0 | 0 | 0 | 161 | 99% | 1 |
| 2 | CuAg1 | 99.0 | 1.00 | 0 | 0 | 0 | 0 | 233 | 92% | 2.27 |
| 3 | CuAgNiZn | 98.6 | 0.48 | 0 | 0.45 | 0.48 | 0 | 215 | 68% | 1.61 |
| 4 | CuAgNiZn | 99.7 | 0.10 | 0 | 0.10 | 0.11 | 0 | 192 | 91% | 1.13 |
| 5 | CuAgSnNi | 99.7 | 0.12 | 0.13 | 0.09 | 0 | 0 | 193 | 84% | 1.15 |
| 6 | CuAgZnAl | 99.7 | 0.10 | 0 | 0 | 0.10 | 0.09 | 170 | 84% | 1.13 |
| 7 | CuSnZnAl | 99.7 | 0 | 0.12 | 0 | 0.11 | 0.12 | 174 | 78% | 1 |

Sample no. 2 is a reference alloy having 99% copper and 1% silver. This alloy has attractive properties in terms of strength and conductivity, but is only usable economically in very specific applications because of the high metal costs.

Sample no. 3 is a copper alloy having about 0.5% silver, 0.5% nickel and 0.5% zinc. This alloy achieves a strength about 35% greater than that of pure copper. The electrical conductivity is 68% IACS.

Sample no. 4 is a copper alloy having about 0.1% silver, 0.1% nickel and 0.1% zinc. This alloy achieves a strength about 20% greater than that of pure copper. The electrical conductivity is 91% IACS. The relative increase in strength is thus much greater than the relative decrease in electrical conductivity. This surprising combination of properties of the alloy is not to be expected from the individual contributions of the individual alloying elements. The relative increase in metal costs is smaller than the relative increase in strength and can therefore be compensated for, for example, by a reduction in the cross section of the conductor bars. Thus, this alloy offers a very attractive combination of properties for use in cast cage rotors for asynchronous machines.

Sample no. 5 is a copper alloy having about 0.1% silver, 0.13% tin and 0.1% nickel. This alloy achieves a strength about 20% greater than that of pure copper. The electrical conductivity is 84% IACS. The relative increase in strength is thus greater than the relative decrease in electrical conductivity. This surprising combination of properties of the alloy is not to be expected from the individual contributions of the individual alloying elements. The relative increase in metal costs is smaller than the relative increase in strength.

Sample no. 6 is a copper alloy having about 0.1% silver, 0.1% zinc and 0.1% aluminum. This alloy achieves a strength about 6% greater than that of pure copper. The electrical conductivity is 84% IACS. Because of the elements Zn and Al, this alloy is an inexpensive alternative.

Sample no. 7 is a copper alloy having about 0.1% tin, 0.1% zinc and 0.1% aluminum. This alloy achieves a strength about 8% greater than that of pure copper. The electrical conductivity is 78% IACS. Since this alloy does not contain any silver, it is a particularly inexpensive alternative.

The invention claimed is:

1. A cage rotor made from a copper alloy having the following composition, in % by weight:
- 0.05% to 0.5% of each of at least three elements selected from the group consisting of Ag, Ni, Zn, Sn and Al,
- the balance being Cu and unavoidable impurities and,
- optionally, 0.01% to 0.2% of one or more elements selected from the group consisting of Mg, Ti, Zr, B, P, As and Sb, said cage rotor comprising a plurality of conductor bars and two short-circuiting rings, characterized in that the conductor bars and the short-circuiting rings have been cast in one piece.

2. The cage rotor as claimed in claim 1 having the following composition, in % by weight:
- 0.05% to 0.5% of each of three elements selected from the group consisting of Ag, Ni, Zn, Sn and Al,
- the balance being Cu and unavoidable impurities and,
- optionally, 0.01% to 0.2% of one or more elements selected from the group consisting of Mg, Ti, Zr, B, P, As and Sb.

3. The cage rotor as claimed in claim 2 having the following composition, in % by weight:
- 0.06% to 0.3% of each of three elements selected from the group consisting of Ag, Ni, Zn, Sn and Al,
- the balance being Cu and unavoidable impurities and,
- optionally, 0.01% to 0.2% of one or more elements selected from the group consisting of Mg, Ti, Zr, B, P, As and Sb.

4. The cage rotor as claimed in claim 3 having the following composition, in % by weight:
- 0.06% to 0.15% of each of three elements selected from the group consisting of Ag, Ni, Zn, Sn and Al, the balance being Cu and unavoidable impurities and,
optionally, 0.01% to 0.2% of one or more elements from the group consisting of Mg, Ti, Zr, B, P, As and Sb.

5. The cage rotor as claimed in claim 1, characterized in that the ratio of the proportions by weight of any two alloying elements selected from the group consisting of Ag, Ni, Zn, Sn and Al is not more than 1.5.

6. The cage rotor as claimed in claim 2 having the following composition, in % by weight:
Ag: 0.06% to 0.5%
Ni: 0.06% to 0.5%
Zn: 0.06% to 0.5%
the balance being Cu and unavoidable impurities and,
optionally, 0.01% to 0.2% of one or more elements selected from the group consisting of Mg, Ti, Zr, B, P, As and Sb.

7. The cage rotor as claimed in claim 6 having the following composition, in % by weight:
Ag: 0.06% to 0.15%
Ni: 0.06% to 0.15%
Zn: 0.06% to 0.15%
the balance being Cu and unavoidable impurities and,
optionally, 0.01% to 0.2% of one or more elements selected from the group consisting of Mg, Ti, Zr, B, P, As and Sb.

8. The cage rotor as claimed in claim 4 having the following composition, in % by weight:
Ag: 0.06% to 0.15%
Sn: 0.06% to 0.15%
Ni: 0.06% to 0.15%
the balance being Cu and unavoidable impurities and,
optionally, 0.01% to 0.2% of one or more elements selected from the group consisting of Mg, Ti, Zr, B, P, As and Sb.

9. The cage rotor as claimed in claim 4 having the following composition, in % by weight:
Ag: 0.06% to 0.15%
Zn: 0.06% to 0.15%
Al: 0.06% to 0.15%
the balance being Cu and unavoidable impurities and,
optionally, 0.01% to 0.2% of one or more elements selected from the group consisting of Mg, Ti, Zr, B, P, As and Sb.

10. The cage rotor as claimed in claim 4 having the following composition, in % by weight:
Sn: 0.06% to 0.15%
Zn: 0.06% to 0.15%
Al: 0.06% to 0.15%
the balance being Cu and unavoidable impurities and,
optionally, 0.01% to 0.2% of one or more elements selected from the group consisting of Mg, Ti, Zr, B, P, As and Sb.

* * * * *